US011840980B1

(12) United States Patent
Dudzik et al.

(10) Patent No.: US 11,840,980 B1
(45) Date of Patent: Dec. 12, 2023

(54) SYSTEMS AND METHODS FOR SELECTIVE HYDROCARBON INJECTION

(71) Applicant: International Engine Intellectual Property Company, LLC, Lisle, IL (US)

(72) Inventors: Artur A Dudzik, Addison, IL (US); Steven Joseph Dickerson, Lake in the Hills, IL (US); Steven M. Ryan, Aurora, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 0 days.

(21) Appl. No.: 17/881,059

(22) Filed: Aug. 4, 2022

(51) Int. Cl.

| | |
|---|---|
| ***F01N 3/00*** | (2006.01) |
| ***F02D 41/40*** | (2006.01) |
| ***F01N 3/023*** | (2006.01) |
| ***F02D 41/00*** | (2006.01) |
| ***F02M 26/22*** | (2016.01) |
| ***F02D 41/02*** | (2006.01) |

(52) U.S. Cl.
CPC ..... *F02D 41/405* (2013.01); *F01N 3/023* (2013.01); *F02D 41/0047* (2013.01); *F02D 41/0087* (2013.01); *F02D 41/029* (2013.01); *F02M 26/22* (2016.02)

(58) Field of Classification Search
CPC ..... F02D 41/405; F02D 41/0047; F02D 41/0087; F02D 41/029; F01N 3/023; F02M 26/22
See application file for complete search history.

(56) References Cited

U.S. PATENT DOCUMENTS

| | | | | |
|---|---|---|---|---|
| 10,247,072 | B2 * | 4/2019 | Younkins | F01N 3/2066 |
| 2005/0223697 | A1 * | 10/2005 | Onodera | F02M 26/50 60/297 |
| 2010/0186384 | A1 * | 7/2010 | Gonze | F01N 3/025 60/320 |
| 2011/0120090 | A1 * | 5/2011 | Sorensen, Jr. | F01N 9/002 60/274 |

(Continued)

FOREIGN PATENT DOCUMENTS

JP 2016113900 A * 6/2016

*Primary Examiner* — Matthew T Largi
(74) *Attorney, Agent, or Firm* — Mark C. Bach; Umang Khanna

(57) ABSTRACT

A method of selective hydrocarbon injection in in-cylinder late post injection in an exhaust manifold of a diesel engine comprises providing the exhaust manifold of the diesel engine comprising a plurality of cylinders, an exhaust gas recirculation valve disposed adjacent the exhaust manifold, a diesel particulate filter disposed adjacent the exhaust manifold, an exhaust gas recirculation cooler disposed adjacent the exhaust manifold offset from the exhaust gas recirculation valve, and an engine control unit operatively connected with the diesel engine for controlling at least the plurality of cylinders. At least a first cylinder is disabled via the engine control unit to reduce post injection of hydrocarbons during regeneration of the diesel particulate filter. The diesel particulate filter is regenerated. In-cylinder late post injection of hydrocarbons is conducted during regeneration of the diesel particulate filter via cylinders other than the first cylinder.

7 Claims, 2 Drawing Sheets

(56) References Cited

U.S. PATENT DOCUMENTS

| | | | | |
|---|---|---|---|---|
| 2011/0203258 | A1* | 8/2011 | Makartchouk | F02D 41/0087 60/274 |
| 2014/0090360 | A1* | 4/2014 | Wilson | F01N 3/208 60/285 |
| 2015/0135680 | A1* | 5/2015 | Ancimer | F02D 17/00 60/274 |
| 2016/0251012 | A1* | 9/2016 | Schneider | F01N 3/2066 701/22 |

* cited by examiner

SYSTEMS AND METHODS FOR SELECTIVE HYDROCARBON INJECTION

TECHNICAL FIELD

The present disclosure relates to a method for selective hydrocarbon injection in in-cylinder late post injection of hydrocarbons during regeneration of a diesel particulate filter. Specifically, in stationary diesel particulate filter regeneration, selective restriction of at least one cylinder in in-cylinder late post injection reduces hydrocarbons near an exhaust gas recirculation valve, thereby reducing hydrocarbons passed through to an exhaust gas recirculation cooler or other exhaust components, thereby protecting these items.

BACKGROUND

A diesel engine in a vehicle, such as a truck and the like, may have a diesel particulate filter ("DPF") to trap soot generated by burning of diesel fuel and prevent the same from being exhausted to environment. Soot and other particulates from diesel fuel burning are particularly damaging to air quality. The DPF may capture between 85% and nearly 100% of diesel particulate matter from an exhaust stream of a diesel engine.

Over time, the diesel particulate matter in soot form accumulates in the DPF, which then must be "regenerated," meaning that the soot must be removed from the DPF. Typically, the DPF can be regenerated by incinerating the soot that is built up therein. Typically, this occurs by heating the DPF to a temperature necessary for incinerating the soot, which is then converted to ash and released as gaseous carbon dioxide.

In-cylinder late post injection is used to aid in regeneration of DPF. Specifically, additional fuel is injected into a combustion chamber by cylinders after a power stroke and just before an exhaust stroke of an engine, thereby delivering hydrocarbons into the exhaust stream. These hydrocarbons are then catalyzed in a diesel oxidation catalyst ("DOC") to produce heat for the diesel particulate filter ("DPF") to regenerate. In-cylinder late post injection in such a manner exposes certain exhaust components to higher than normal amounts of raw hydrocarbons, particularly to components in the exhaust stream, which can be damaging to exhaust component.

Specifically, an exhaust gas recirculation valve ("EGRV") remains closed during the regeneration event. Leakage of hydrocarbons from the EGRV is typically relatively low at the start of the EGRV life; however, as the EGRV ages, leakage of hydrocarbons can occur, passing the hydrocarbons into an exhaust gas recirculation cooler ("EGRC"), causing spoilage, plugging, and/or fouling of the same.

Generally, there are two different types of regeneration events where the late post injection of the hydrocarbons is used, during so-called "rolling" and "stationary" regeneration events. A "rolling" regeneration event occurs when the vehicle is in motion, typically as the truck drives down a road and the engine is subject to various speeds and load conditions. A "stationary" regeneration event occurs while the vehicle is parked and the engine condition is optimized to perform the regeneration event.

As noted above, the EGRC can become plugged or otherwise fouled due to higher than normal hydrocarbons passing through the EGRV during a DPF regeneration event. A stationary regeneration event creates a particularly unfavorable condition that allows hydrocarbons to pass through the EGRV and foul the EGRC.

A need, therefore, exists for an improved system and an improved method for reducing exhaust component fouling during a DPF regeneration event. Specifically, a need exists for an improved system and an improved method for reducing hydrocarbons from passing through the EGRV during the DPF regeneration event. More specifically, a need exists for an improved system and an improved method for reducing hydrocarbons from passing the EGRV, especially during a stationary regeneration event.

Moreover, a need exists for an improved system and an improved method for reducing or eliminating fouling of an exhaust component. Specifically, a need exists for an improved system and an improved method for reducing or eliminating EGRC fouling or plugging during in-cylinder late post injection. More specifically, a need exists for an improved system and an improved method that selectively restrict cylinder usage during in-cylinder late post injection, thereby reducing hydrocarbons in the exhaust stream.

SUMMARY

Embodiments described herein provide a method of selective hydrocarbon injection in in-cylinder late post injection in an exhaust manifold of a diesel engine comprises providing the exhaust manifold of the diesel engine comprising a plurality of cylinders, an exhaust gas recirculation valve disposed adjacent the exhaust manifold, a diesel particulate filter disposed adjacent the exhaust manifold, an exhaust gas recirculation cooler disposed adjacent the exhaust manifold offset from the exhaust gas recirculation valve, and an engine control unit operatively connected with the diesel engine for controlling at least the plurality of cylinders. At least a first cylinder is disabled via the engine control unit to reduce post injection of hydrocarbons during regeneration of the diesel particulate filter. The diesel particulate filter is regenerated. In-cylinder late post injection of hydrocarbons is conducted during regeneration of the diesel particulate filter via cylinders other than the first cylinder.

DETAILED DESCRIPTION

The present disclosure relates to a method for selective hydrocarbon injection in in-cylinder late post injection of hydrocarbons during regeneration of a diesel particulate filter. Specifically, in stationary diesel particulate filter regeneration, selective restriction of at least one cylinder comprising a diesel engine in in-cylinder late post injection reduces hydrocarbons near an exhaust gas recirculation valve, thereby reducing hydrocarbons passed through to an exhaust gas recirculation cooler or other exhaust components, thereby protecting the same.

Figure 1:
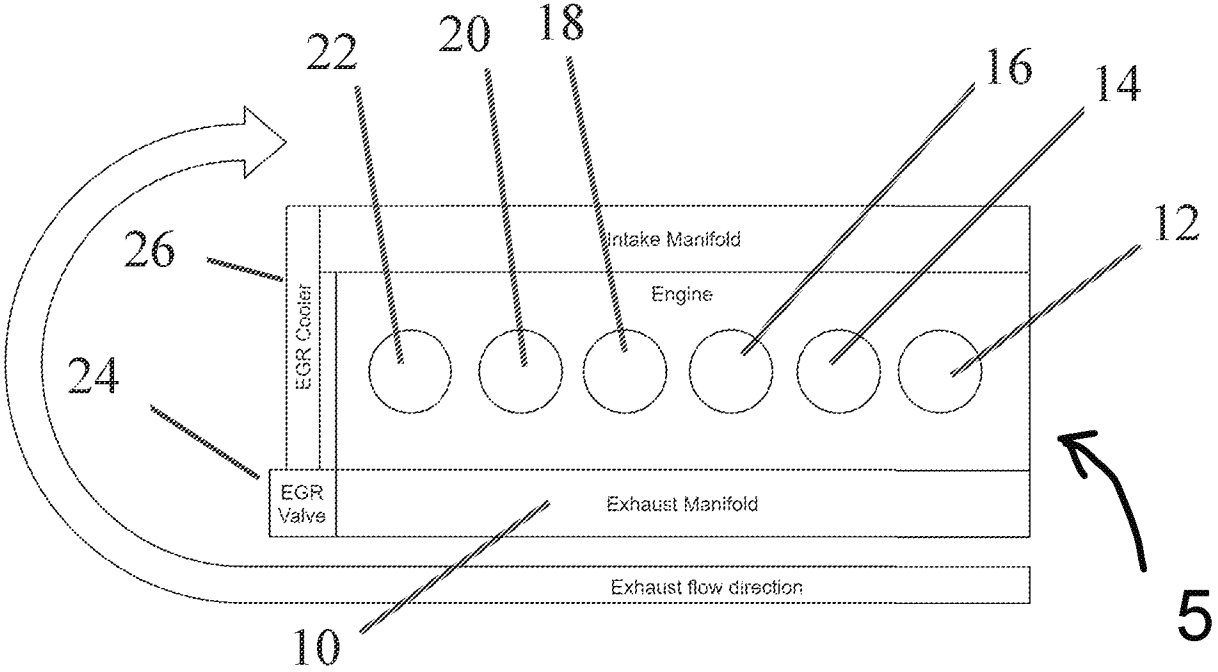
FIG. 1 PRIOR ART
FIG. 1 is a diagram of prior art exhaust gas recirculation system for a vehicle.

Now referring to the figures, FIG. 1 illustrates a prior art exhaust manifold 10 for a diesel engine 5 on a vehicle, such as a truck, a trailer tractor and the like. The exhaust manifold 10 comprises a plurality of cylinders 12, 14, 16, 18, 20, 22, six being shown but more or less cylinders can be used, each having a combustion chamber that is typically utilized to provide power for moving the vehicle. As particulate matter builds on a diesel particulate filter (DPF) disposed adjacent the exhaust manifold 10, a regeneration event is required to clear the particulate matter from the diesel particulate filter and increase life of the diesel particulate filter. Heat is generated using in-cylinder late post injection that delivers hydrocarbons into an exhaust stream. Specifically, additional fuel is injected into combustion chambers of the plurality of cylinders 12, 14, 16, 18, 20, 22 after a power stroke and just before an exhaust stroke of the diesel engine 5. The hydrocarbons of this additional fuel are then catalyzed in a diesel oxidation catalyst to produce heat for the DPF to regenerate, converting the particulate matter soot into ash and gaseous carbon dioxide.

Typically, the in-cylinder late post injection of hydrocarbons occurs during either a stationary or a rolling regeneration event. During a stationary regeneration event, unfavorable conditions cause hydrocarbons to pass an exhaust gas recirculation valve ("EGRV") 24 disposed adjacent the exhaust manifold 10, causing plugging and fouling of an exhaust gas recirculation cooler ("EGRC") 26 disposed adjacent the exhaust manifold 10 and offset from the EGRV 24 in an engine exhaust path, indicated by arrow of FIG. 1. During certain diesel engine operating conditions, an engine control unit (ECU) operatively connected with the diesel engine commands the EGRV 24 to be in a closed position to reduce additional hydrocarbons from passing therethrough and fouling exhaust components.

Typically, in-cylinder late post injection induces high differential pressure across the EGRV 24, which may be a cause of leakage of hydrocarbons through the EGRV 24. As the EGRV 24 wears over time, the EGRV 24 may reach a condition such that exhaust pressure against the EGRV 24 exceeds capability of the EGRV 24 to remain closed. Disabling one or more of the plurality of cylinders 12, 14, 16, 18, 20, 22 in the exhaust manifold 10 during a stationary regeneration event may reduce an amount of hydrocarbons near the EGRV 24, thereby reducing hydrocarbons that can pass through the EGRV 24 and foul the EGRC 26 and/or other exhaust components.

Figure 2:
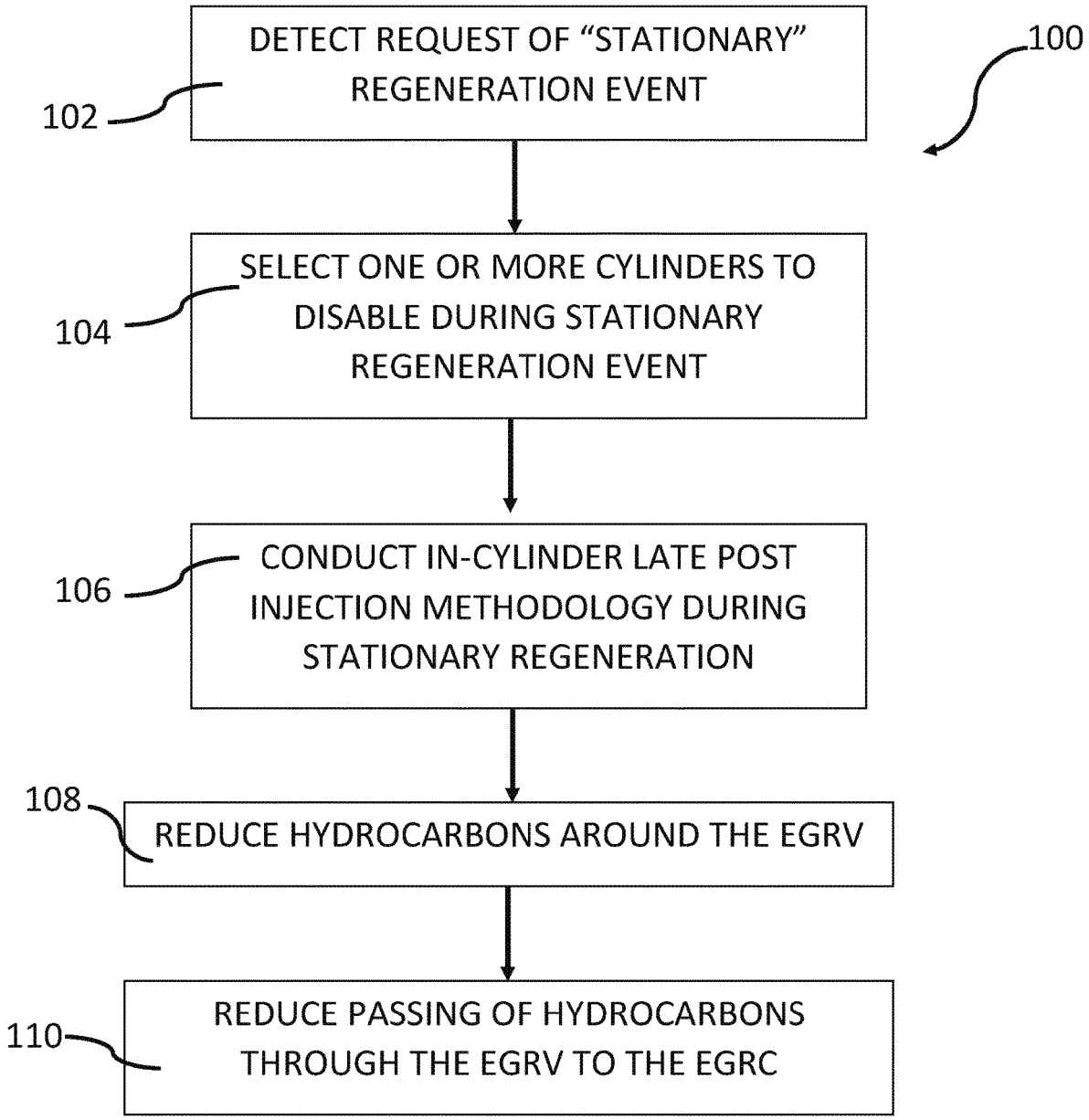
FIG. 2 is a chart showing an exemplary methodology for reducing fouling of exhaust components by reducing hydrocarbons near an EGRV of an exhaust gas recirculation system for a vehicle.

FIG. 2 shows one embodiment of a methodology 100 wherein the ECU or other software component of the diesel engine that may disable at least one of the plurality of cylinders 12, 14, 16, 18, 20, 22 during an in-cylinder late post injection. Specifically, in a first step 102, the ECU or other software component may recognize that a "stationary" regeneration event is requested. The ECU or other software may then select at least one of the plurality of cylinders 12, 14, 16, 18, 20, 22 via step 104 to be disabled during the regeneration event so that the selected one of the plurality of cylinders 12, 14, 16, 18, 20, 22 may not be allowed to post inject hydrocarbons during the in-cylinder late post injection via step 106.

For example, the plurality of cylinders 12, 14, 16, 18, 20, 22 may be arranged such that exhaust gases from cylinders 18, 20, 22 may be routed to the EGRV 24. In one embodiment, exhaust gases from cylinders 12, 14, 16 may be routed to a turbocharger (not shown), which may be positioned between third cylinder 16 and fourth cylinder 18. The ECU or other software may select at least one of the plurality of cylinders 12, 14, 16, 18, 20, 22 closest to the EGRV 24 to be disabled via step 104. Specifically, in one embodiment, a cylinder 22 may be selected to be disabled. Alternately, two of the cylinders 20, 22 may be selected to be disabled. Alternately, three of the cylinders 18, 20, 22 may be selected to be disabled. Disabling one or more of the plurality of cylinders 12, 14, 16, 18, 20, 22 may present less hydrocarbons around the EGRV 24 via step 108, thereby reducing passing of the hydrocarbons through the EGRV 24 to the EGRC 26 and/or other exhaust components via step 110.

Although the exhaust manifold 10 is shown and described herein as having six cylinders 12, 14, 16, 18, 20, 22, it should be noted that other embodiments of the methodology 100 may be utilized with an exhaust manifold with any number of cylinders comprising the plurality of cylinders mentioned herein. Moreover, although embodiments of an improved system and embodiments of an improved method described herein are utilized to protect the exhaust gas regeneration cooler 26, other embodiments of an improved system and other embodiments of an improved method can protect another exhaust component, combination of exhaust components or the like as desired.

We claim:

1. A method of selective hydrocarbon injection in in-cylinder late post injection in an exhaust manifold of a diesel engine, the method comprising the steps of:

providing the exhaust manifold of the diesel engine, the diesel engine comprising a plurality of cylinders, an exhaust gas recirculation valve disposed adjacent the exhaust manifold, a diesel particulate filter disposed adjacent the exhaust manifold, an exhaust gas recirculation cooler disposed adjacent the exhaust manifold offset from the exhaust gas recirculation valve, and an engine control unit operatively connected with the diesel engine for controlling at least the plurality of cylinders;

disabling at least a first cylinder of the plurality of cylinders closest to the exhaust gas recirculation valve relative to the other cylinders via the engine control unit to reduce post injection of hydrocarbons around and through the exhaust gas recirculation valve from the at least first cylinder during an in-cylinder late post injection of hydrocarbons during regeneration of the diesel particulate filter;

regenerating the diesel particulate filter; and conducting in-cylinder late post injection of hydrocarbons during regeneration of the diesel particulate filter via cylinders comprising the plurality of cylinders other than the first cylinder.

2. The method of claim 1 further comprising the step of:

disabling a second cylinder of the plurality of cylinders closest to the exhaust gas recirculation valve relative to the other cylinders via the engine control unit to prevent post injection of hydrocarbons from the second cylinder during in-cylinder late post injection during regeneration of the diesel particulate filter.

3. The method of claim 2 further comprising the step of:

disabling a third cylinder of the plurality of cylinders closest to the exhaust gas recirculation valve relative to the other cylinders via the engine control unit to prevent post injection of hydrocarbons from the third cylinder during in-cylinder late post injection during regeneration of the diesel particulate filter.

4. The method of claim 3 further comprising the step of:

routing exhaust gases from at least one of the remaining plurality of other cylinders to a turbocharger.

5. The method of claim 1 further comprising the steps of:

detecting a stationary regeneration event request; and conducting in-cylinder late post injection of hydrocarbons when the stationary regeneration event is requested.

6. The method of claim 1 further comprising the step of:

reducing an amount of hydrocarbons through the exhaust gas recirculation cooler during the in-cylinder late post injection of the hydrocarbons compared to when the first cylinder is not disabled.

7. The method of claim 1 further comprising the step of: closing the exhaust gas recirculation valve during an in-cylinder late post injection of the hydrocarbons during the regeneration of the diesel particulate filter.

* * * * *